US005690090A

United States Patent [19]

Bissonnette

[11] Patent Number: 5,690,090

[45] Date of Patent: Nov. 25, 1997

[54] LANYARD RETAINER FOR A SPEARGUN PROJECTILE

[76] Inventor: Laurent C. Bissonnette, 160 Sea Meadow Dr., Portsmouth, R.I. 02871

[21] Appl. No.: 668,034

[22] Filed: Jun. 17, 1996

[51] Int. Cl.[6] ..... F41B 11/00; F41B 11/08

[52] U.S. Cl. ..... 124/80; 124/56; 102/399; 102/504

[58] Field of Search ..... 124/1, 56, 69, 124/73, 74, 75, 76, 80; 43/6; 102/399, 504; 273/416

[56] References Cited

U.S. PATENT DOCUMENTS

| | | | |
|---|---|---|---|
| 265,969 | 10/1882 | Lyon et al. | 102/504 |
| 267,027 | 11/1882 | Shaw | 102/504 X |
| 2,101,198 | 12/1937 | Robinson | 124/69 |
| 2,805,622 | 9/1957 | Cammin-Christy | 102/504 |
| 2,923,286 | 2/1960 | Draganti | 124/69 X |
| 3,669,087 | 6/1972 | Hamrick et al. | 124/74 |
| 3,717,947 | 2/1973 | Nomura | 124/73 X |
| 3,910,189 | 10/1975 | Whidden et al. | 102/504 X |
| 4,505,179 | 3/1985 | Nelson et al. | 102/504 X |
| 5,086,749 | 2/1992 | Ekstrom | 124/74 |
| 5,373,832 | 12/1994 | D'Andrade | 124/69 |
| 5,373,833 | 12/1994 | D'Andrade | 124/69 |
| 5,398,587 | 3/1995 | Kornblith | 102/504 X |

*Primary Examiner*—John A. Ricci

*Attorney, Agent, or Firm*—Michael J. McGowan; Robert W. Gauthier; Prithvi C. Lall

[57] ABSTRACT

A lanyard retainer for use in a breech loading hydraulic speargun. A projectile is attached to the retainer and the retainer and projectile are inserted into the breech end of the speargun barrel with the retainer sealing the breech end of the barrel. A trigger mechanism on the speargun releases water under pressure into the barrel at the location of the connection between the projectile and the retainer. The projectile separates from the retainer and is ejected out the muzzle end of the barrel while the retainer remains in the barrel. The retainer has a forward spindle portion about which a lanyard is wound. The rear portion of the retainer serves as the breech seal and the shoulder between the spindle and the rear portion prevents the lanyard from unwinding onto the rear portion and helps to prevent operator entanglement with the lanyard. The lanyard is attached between the retainer and the projectile such that the lanyard is payed out through the barrel as the projectile travels to its target. The retainer is removable from the barrel and is made buoyant for convenient retrieval of the projectile.

10 Claims, 2 Drawing Sheets

LANYARD RETAINER FOR A SPEARGUN PROJECTILE

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED PATENT APPLICATIONS

This patent application is co-pending with related patent applications entitled Hydraulic Impulse Speargun (Ser. No. 08/568033) and Speargun Projectile Assembly (Ser. No. 08/668033) by the same inventor as this application.

BACKGROUND OF THE INVENTION (1) Field of the Invention

The present invention relates to underwater spearguns, and deals more particularly with an apparatus for retaining the lanyard connected between the gun and the projectile launched from the gun without entangling the operator of the gun.

(2) Description of the Prior Art

Underwater guns of the type used to spear fish generally provide for some form of elastic or pneumatic catapult system to launch the projectiles. In the elastic catapult a long spear is launched by means of a stretched elastic band. The elastic band is stretched and attached to the spear. The spear is prevented from moving by a trigger mechanism. When the trigger is actuated, the elastic band contracts and catapults the spear from the gun. In the pneumatic catapult type of speargun, an air spring is provided for launching the projectile. The speargun is loaded by forcing the spear or a special loading pole against an air piston, compressing the air behind the piston. The spears are typically attached to the guns by lanyards such that fish or the spear itself can be retrieved when the gun is discharged in water. The lanyards on present spearguns are most often coiled along the gun barrel. When the gun is discharged, the coiled lanyard unravels rapidly and may easily entangle the gun operator. If the operator wishes to fire another projectile, the lanyard and projectile must be retrieved and the lanyard rewound on the barrel, or the existing lanyard must be removed from the speargun and a new lanyard is rewound on the barrel and attached to a new projectile. In the latter case, the projectile previously fired may be lost.

SUMMARY OF THE INVENTION

Accordingly, it is a general purpose and object of the present invention to provide a lanyard system for a speargun which does not expose the speargun operator to entanglement with the lanyard. Another object is to provide a speargun with a lanyard system which allows more rapid firing of numerous projectiles. A still further object is to provide a lanyard system which minimizes the possibility of losing the projectile and any attached catch.

These objects are accomplished with the present invention by providing a lanyard retainer with an attached projectile. One end of the lanyard is attached to the projectile and the other end is attached to and wound around the retainer. When the trigger mechanism of the speargun is activated, the projectile separates from the retainer and is launched. The retainer remains with the gun and the lanyard is payed out as the projectile travels through the water. The retainer is shaped to prevent entanglement of the operator as the lanyard is payed out. The retainer is made buoyant and removable from the speargun. A number of retainers and attached projectiles may be carried by the operator. If the operator wishes to quickly fire a second projectile, he can merely remove the retainer from the previous shot and allow it to float free and install a new retainer and attached projectile. The buoyancy of the retainer allows for easy recovery of the projectile and any attached catch. The lanyard can be rewound onto the retainer and a previously launched projectile reattached to the retainer should the operator exhaust his supply of retainers or projectiles. The retainer is ideally suited for use with a breech loaded speargun, but may be adapted for use with any speargun.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
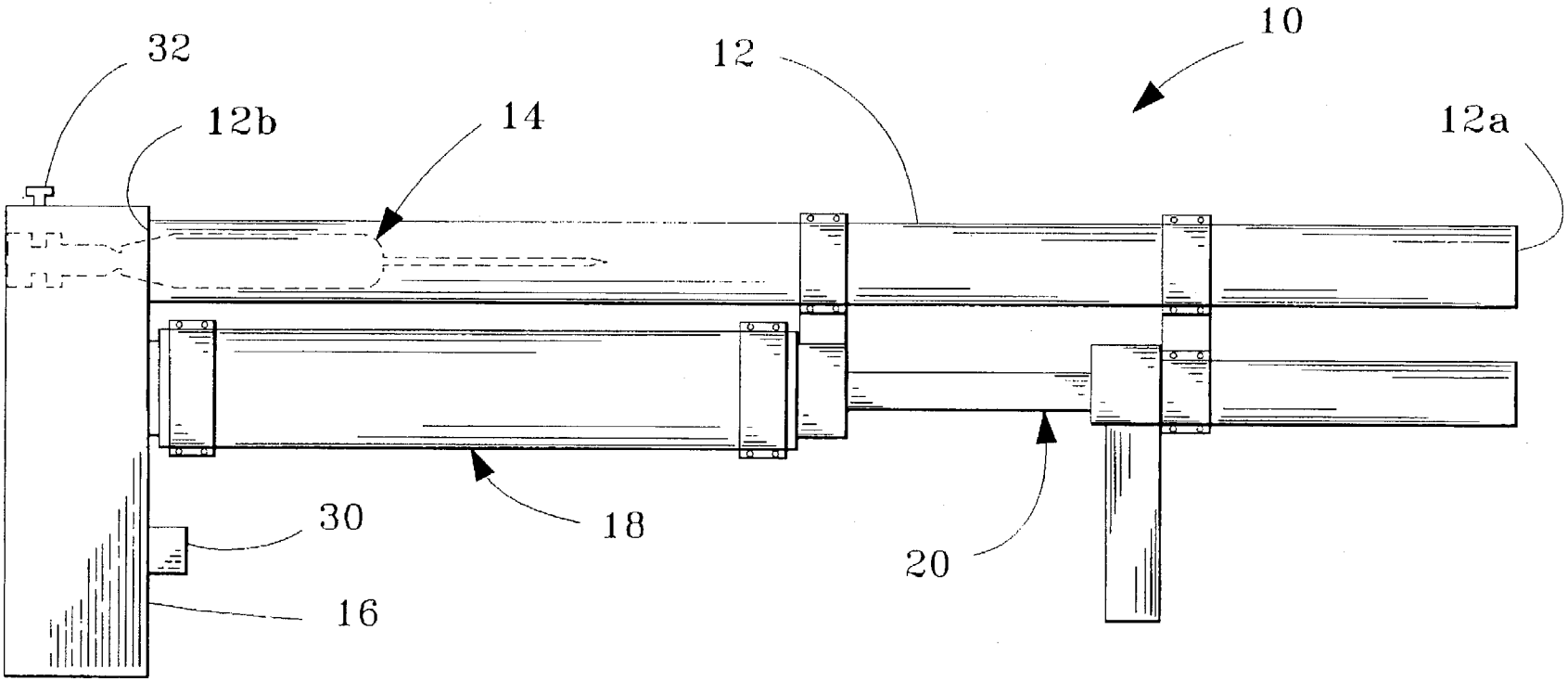
FIG. 1 show the preferred form for a speargun for which the present invention is ideally suited.
Figure 2:
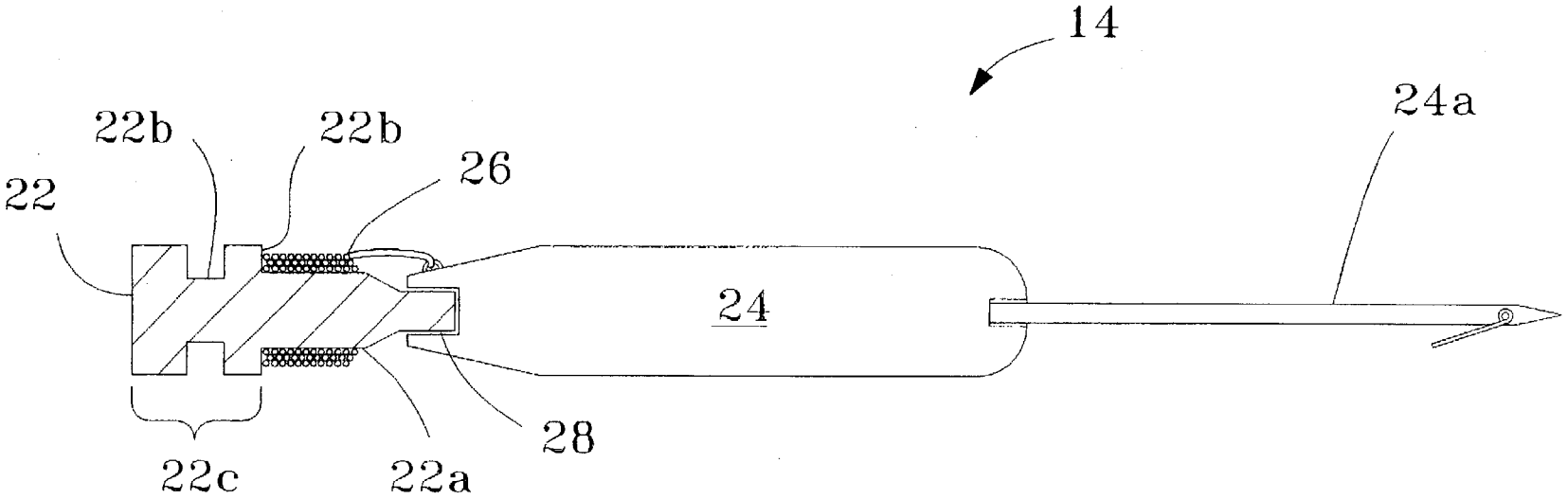
FIG. 2 shows a detail of the retainer with a projectile attached.

Referring now to FIG. 1, a speargun 10, for which the preferred embodiment is ideally suited, is illustrated as comprising a barrel 12, having a muzzle end **12*a* and an opposite breech end 12*b*, the latter being closed by projectile assembly 14 shown in phantom. Barrel 12 is secured to stock 16. Elastomeric bladder assembly 18 is secured to stock 16 at one end and is supported on the other end by pump mechanism 20. pump mechanism 20 is attached to barrel 12. Referring now additionally to FIG. 2, projectile assembly 14 is shown to consist of retainer 22 and attached projectile 24. Lanyard 26 is secured to and coiled around a spindle portion 22*a* of retainer 22. The other end of lanyard 26 is secured to projectile 24 from which spear end 24*a* protrudes. Projectile 24 and retainer 22 are joined by snap joint 28 so as to avoid loss of projectile 24 during handling prior to firing of speargun 10**.

Upon entering the water, the user will breech load assembly 14 into breech end **12*b* of barrel 12. With speargun 10 loaded, the diver or user can then conveniently charge the gun by operating pump mechanism 20. In the speargun for use with the preferred embodiment, pump mechanism 20 is hand operated by a series of back and forth strokes. A stroke in one direction allows water to enter pump mechanism 20 and a stroke in the other forces water from pump mechanism 20 into bladder 18 under pressure. A set of check valves in pump mechanism 20 prevents flow in the opposite direction. Depressing trigger 30 causes pressurized fluid to enter breech end 12*b* of barrel 12 at a point near snap joint 28. Snap joint 28 is made such that the force of the water from bladder 18 will overcome the limited frictional forces required to retain projectile 24 in the position shown. projectile 24 separates from retainer 22 and is launched from muzzle end 12*a* of barrel 12. Retainer 22 remains within barrel 12 and lanyard 26 is payed out behind projectile 24 from spindle portion 22*a* of retainer 22 as projectile 24** travels through the water. Shoulder 22*b*, adjacent to spindle portion 22*a*, prevents lanyard 26 from unraveling onto rear portion 22*c* of retainer 22. In the preferred embodiment for use with speargun 10 described, rear portion 22*c* serves as a breech plug for barrel 12. Slot 22*d* is formed in rear portion 22*c* and cooperates with release mechanism 32 which holds retainer 22 within barrel 12. Once speargun 10 is fired, release mechanism 32 can be withdrawn from slot 22*d* such that retainer 22 can be removed through muzzle end 12*a* of barrel 12. Retainer 22 is preferably buoyant to permit retainer 22 and projectile 24 to be readily retrieved when retainer 22 is released from barrel 12. Releasing retainer 22 further allows the user to reload quickly. The diver preferably has a number of projectile assemblies 14 so as to permit him to load and fire the gun several times before retrieving his equipment and any catch obtained from use of the speargun.

What has thus been described is a lanyard retainer which is breech loaded into a speargun barrel with an attached projectile. The retainer serves to seal the breech end of the barrel. A notch within the retainer cooperates with a release mechanism to hold the retainer within the barrel. A trigger mechanism releases pressurized water from a bladder portion of the speargun into the breech end of the barrel of the gun. The pressurized fluid forces the projectile to separate from the retainer and the projectile is launched out the muzzle end of the barrel by the force of the water. A lanyard is attached between the retainer and the projectile and is coiled about a forward or spindle end of the retainer. As the projectile travels from the muzzle, the lanyard is deployed through the muzzle end of the barrel. The release mechanism can be withdrawn from the slot to release the retainer from the barrel.

The retainer, speargun and projectile shown and described herein is much safer and easier to load and to use then present elastic or pneumatic spearguns. The retainer and projectile can be loaded into the gun without charging the firing mechanism. Charging the speargun for firing requires a simple back and forth pumping action and is separate from loading the retainer and projectile. Stowage of the lanyard within the barrel prevents entanglement and is inherently safer than present designs. The buoyant retainer facilitates rapid firing and reloading of the present speargun without losing the projectile.

Obviously many modifications and variations of the present invention may become apparent in light of the above teachings. For example, the exact shapes and configurations of the particular components shown can be changed to suit manufacturing and assembly considerations. Additionally, the retainer can be adapted for use with conventional elastic or pneumatic catapult spearguns. Present projectiles would be modified to attach to the retainer in a manner similar to that indicated and the speargun would be similarly modified to accept the retainer and projectile assembly. In an elastic catapult gun, the elastic would be attached to the projectile as is currently the case. The retainer would be held in place by a catch mechanism separate from the trigger mechanism used to hold and release the projectile. A similar double catch mechanism would be used in a pneumatic catapult speargun.

In light of the above, it is therefore understood that within the scope of the appended claims, the invention may be practiced otherwise than as specifically described.

What is claimed is:

1. A retainer for a length of lanyard connected at one end to a projectile for use in an underwater gun, the retainer comprising:

a joint means for removably attaching the projectile to the retainer;

a spindle portion for attaching the other end of the lanyard and for receiving the length of the lanyard in a wound manner; and a rear portion removably secured to the underwater gun.

2. The retainer of claim 1 wherein the joint means comprises a snap joint, the joint having a protrusion frictionally interfitting with a slot.

3. The retainer of claim 1 wherein the rear portion further comprises a shoulder adjacent the spindle portion, the shoulder preventing unwinding of the lanyard from the spindle portion onto the rear portion.

4. The retainer of claim 1 wherein the rear portion further comprises a retention slot, the retention slot cooperating with a release mechanism of the underwater gun to secure the retainer to the gun.

5. The retainer of claim 1 wherein the retainer is sufficiently buoyant to maintain the retainer, lanyard and projectile afloat.

6. A retainer for a length of lanyard connected at one end to a projectile for insertion into a breech loading underwater gun using water under pressure to launch the projectile from a barrel, the retainer comprising:

a joint means for removably attaching the projectile to the retainer;

a spindle portion for attaching the other end of the lanyard and for receiving the length of the lanyard in a wound manner; and a rear portion removably secured to the underwater gun, the rear portion serving as a breech plug for said barrel.

7. The retainer of claim 6 wherein the joint means comprises a snap joint, the joint having a protrusion frictionally interfitting with a slot.

8. The retainer of claim 6 wherein the rear portion further comprises a shoulder adjacent the spindle portion, the shoulder preventing unwinding of the lanyard from the spindle portion onto the rear portion.

9. The retainer of claim 6 wherein the rear portion further comprises a retention slot, the retention slot cooperating with a release mechanism of the underwater gun to secure the retainer to the gun.

10. The retainer of claim 6 wherein the retainer is sufficiently buoyant to maintain the retainer, lanyard and projectile afloat.

* * * * *